United States Patent [19]

Dicke

[11] 4,381,628

[45] May 3, 1983

[54] DUST CONTROL SYSTEM FOR SURFACE TREATING MACHINE

[75] Inventor: William C. Dicke, Easley, S.C.

[73] Assignee: The Singer Company, Stamford, Conn.

[21] Appl. No.: 284,844

[22] Filed: Jul. 20, 1981

[51] Int. Cl.[3] ..... B24B 55/06; B24B 23/00

[52] U.S. Cl. ..... 51/170 TL; 51/273; 15/28; 15/344

[58] Field of Search ..... 51/170 TL, 170 R, 170 T, 51/170 MT, 268, 273; 15/28, 344

[56] References Cited

U.S. PATENT DOCUMENTS 3,938,283 2/1976 Keith, Jr. ..... 51/170 TL

*Primary Examiner*—Roscoe V. Parker

*Attorney, Agent, or Firm*—Edward P. Schmidt; Robert E. Smith; Edward L. Bell

[57] ABSTRACT

An electrically driven portable surface treating machine such as a sander, polisher, buffer, and the like, having an oscillatable platen driven from a motor shaft and which creates dust during use, is provided with a dust collection fan on the motor shaft in a fan housing portion of the tool housing and an exhaust outlet or port which can selectively be fitted with dust collection means, such as a filter bag. The oscillatable platen is enclosed within a shroud or skirt and the interior of the shroud or skirt is ducted to the inlet of the dust collection fan housing portion. Between the shroud and the fan, there is provided a selective shutter arrangement which may be selectively opened and closed by the machine operator to enable the machine to be operated in either a "dustless" or a "non-dustless" configuration or mode of operation.

5 Claims, 2 Drawing Figures

DUST CONTROL SYSTEM FOR SURFACE TREATING MACHINE

DESCRIPTION

1. Field of the Invention

This invention relates to electrically driven portable surface cleaning machines such as a sander, polisher, buffer, and the like having an oscillatable platen which creates dust during use and to a dust control method and system therefore.

2. Background of the Invention

Electrically driven portable surface treating machines such as a sander, polisher, buffer, and the like having an oscillatable platen may create dust during use which in many machines is allowed to merely enter the ambient air in the work area. While this is satisfactory under some conditions, under other conditions it is desirable that the dust created be removed from the work area and not be allowed to enter the ambient air therearound. There has been a long standing need for improving the construction or arrangement of such machines so as to selectively provide for the collection of such dust when desired while enabling the machine to be easily and safely operated without dust collection when that mode of operation is satisfactory. A number of dust collection bags and systems have been proposed and, for example, in U.S. Pat. No. 3,938,283, assigned to the assignee of the instant application, there is disclosed a dust collection system including a vacuum fan driven by the machine's electric motor together with a shroud or skirt enclosing the oscillatable platen. The fan creates suction past the oscillatable platen and within the shroud or skirt to vacuum the dust away from the platen as it is created. An exhaust conduit is also provided supporting a dust collection filter bag and a support arm therefore. Such an arrangement, with the dust bag in place, may be referred to as a "dustless" machine.

While effective to collect the dust which the machine creates, the additional bulk of the dust bag and support can, under certain conditions of operation, reduce the convenience of using the machine. Moreover, in some applications the dust collection capability is just not desired by the machine operator. In addition, the basic machine, without the dust collection bag and support may be sold more economically, giving the purchaser the option of later purchasing a dust collection bag as an accessory if "dustless" or "non-dustless" operation of the basic machine can be conveniently and easily selected by the operation. It has been heretofore suggested, therefore, to provide a machine which is convertible between normal or "non-dustless" and "dustless" operation by providing means for closing or blocking the exhaust outlet when "normal" or "non-dustless" operation is desired while enabling the operator to remove or defeat the exhaust closing or locking means and install a dust collector when "dustless" operation is desired. In such an arrangement, however, when the exhaust outlet is closed, some dust can still be collected and impacted within the fan chamber and exhaust outlet.

It has also been previously suggested to utilize a single fan having separate sets of vanes separated by a central flange wherein one set of blades provides for a flow of cooling air past the motor and the other set of blades provides dust collection. A mating flange portion of the machine housing, in planar alignment with the fan flange, separates the two fan halves to isolate the cooling half and the cooling air from the dust handling half. While this construction provides an efficient, effective and inexpensive solution to the provision of cooling air and dust collection, merely closing or blocking the exhaust outlet or port for "non-dustless" or "normal" operation presents a significant danger that additional dust would be impacted within the compartment or drawn into the motor compartment.

OBJECTS OF THE INVENTION

Bearing in mind the foregoing, it is a primary object of the present invention to provide electrically driven portable surface treating machines such as a sander, polisher, buffer, and the like having an oscillatable platen which creates dust during use with means is selectively operable for use in either a "dustless" or "non-dustless" configuration or mode of operation.

Another primary object of the present invention, in addition to the foregoing object, is the provision of such surface treating machines wherein impaction of dust does not occur when operated in a "non-dustless" configuration.

Yet another primary object of the present invention, in addition to each of the foregoing objects, is the provision in such machines of a two sided fan having a central flange and a set of vanes or blades on either side thereof, one set providing cooling air flow past the motor and the other set providing dust collection air flow.

Still another primary object of the present invention, in addition to each of the foregoing objects, is the provision in such machines of novel and improved methods and means for interrupting the flow of dust collecting air to the fan when it is desired to operate the machine in a "non-dustless" configuration.

Another and still further primary object of the present invention, in addition to each of the foregoing objects, is the provision of such surface treating machines which may be sold as "non-dustless" and yet, with the addition of a dust collection bag, or the like, as an optional accessory be selectively converted by the operator to "dustless" operation.

Yet still another primary object of the present invention, in addition to each of the foregoing objects, is the provision of a shutter arrangement between the dust collection fan and the oscillatable platen which can be selectively opened or closed by an operator for operating the machine in a "dustless" or "non-dustless" configuration, respectively.

It is a feature of the present invention, that when the shutter is closed, dust ladden air is positively precluded from entering the machine mechanism.

The invention resides in the combustion, construction, arrangement and disposition of the various component parts and elements incorporated in improved surface treating machines and dust collection methods, apparatus and systems therefore in accordance with the principles of this invention. This invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially if they fall within the scope and spirit of the subjoined claims.

SUMMARY OF THE INVENTION

In accordance with the present invention, an electrically driven portable surface treating machine such as a sander, polisher, buffer, and the like, having an oscillatable platen driven from a motor shaft and which creates dust during use, is provided with a dust collection fan on the motor shaft in a fan housing portion of the tool housing. The fan housing portion is provided with an exhaust outlet or port which can selectively be fitted with dust collection means, such as a filter bag. The oscillatable platen is enclosed within a shroud or skirt and the interior of the shroud or skirt is ducted to the inlet of the dust collection fan housing portion. Between the shroud and the fan, there is provided a selective shutter arrangement which may be selectively opened and closed by the machine operator to enable the machine to be operated in either a "dustless" or a "non-dustless" configuration or mode of operation. In the illustrated embodiment, the shutter arrangement comprises a pair of generally circular superposed plates each of which are provided with a plurality of alternatively radial sector openings and ribs. One of the plates is non-rotatable relative the housing, as by being provided with a radial tang which extends into a mating complementary slot in the tool housing. The other plate is rotatable as by means of a radial tang extending through a slot in the tool housing for operator rotation to align the sector openings thereof selectively with the sector openings of the non-rotatable plate to enable air flow therethrough for dust collection and dustless operation or with the ribs of the non-rotatable plate covering the sector openings of the rotatable plate and the ribs of the rotatable plate covering the sector openings of the non-rotatable plate, isolating the fan and fan housing portion from the shroud or skirt, blocking air flow therethrough and enabling "normal" or "non-dustless" operation of the machine.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

DETAILED DESCRIPTION OF THE INVENTION

Figure 1:
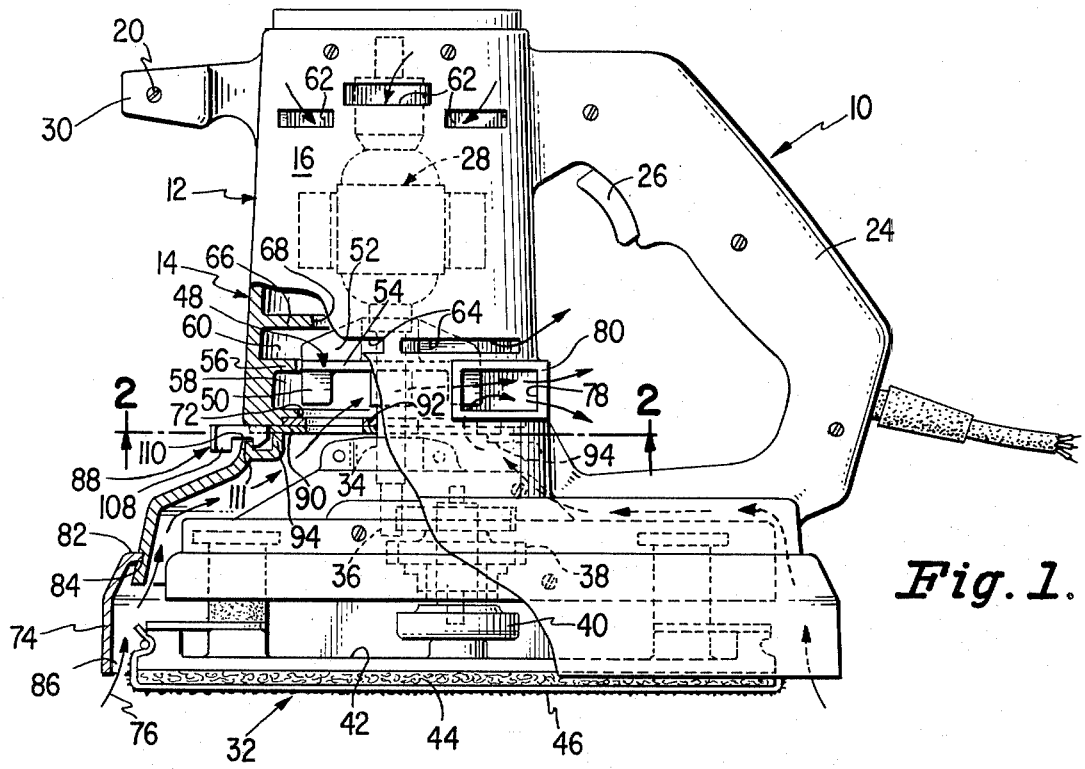
FIG. 1 is a side elevational view, partially broken away, of a surface treating machine constructed in accordance with the principles of the present invention.
Figure 2:
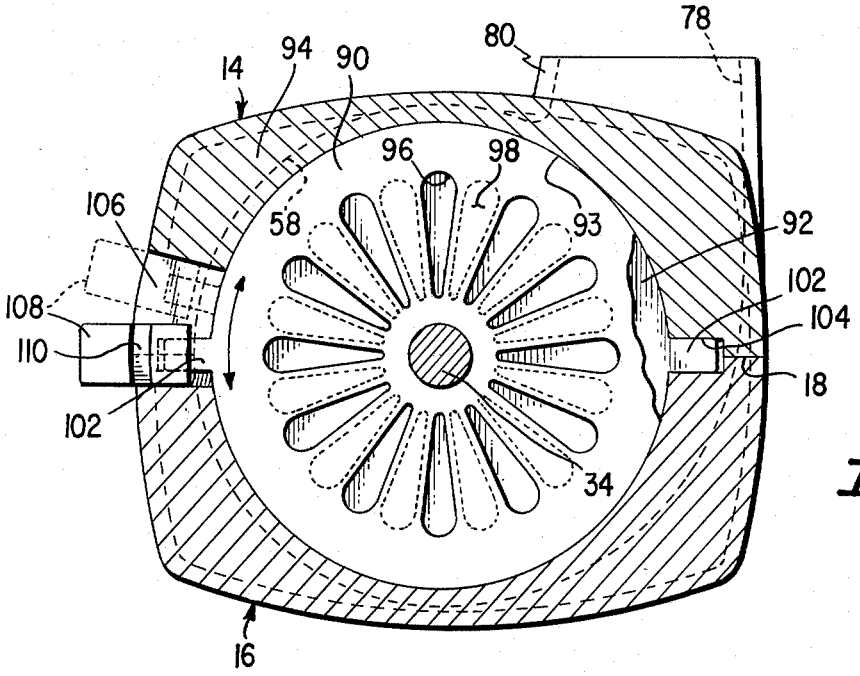
FIG. 2 is an enlarged cross sectional plan view thereof taken substantially along line 2—2 of FIG. 1.

With reference now to the drawing, there is shown and illustrated an electrically driven portable surface treating machine, designated generally by the reference character 10. The surface treating machine 10 is depicted as a sander with a clamshell housing 12 of plastic or like material comprising a pair of complementary halves 14 and 16 which are detachably connected along a longitudinal split 18 by screws 20. Main handle portion 24 formed integral with the housing 12 is provided with an operator controlled electric on-off switch 26 between a motor 28 and a suitable source of electric power. A forwardly positioned auxiliary handle 30 is also provided so that the sander can be grasped and controlled by the operator.

The motor 28 drives a platen assembly 32 disposed within the housing 12 at the bottom thereof. An armature shaft 34 of the motor 28 has a pinion 36 formed on its lower end which connects through a gear reduction mechanism 38 to an eccentric bearing bracket 40 which imparts shiftable motion such as oscilatory, reciprocatory, orbital, or the like, to a rectangular rigid back plate 42 of the oscillatable platen 32.

A resilient pad 44 is bonded to the back plate 42 on which is typically mounted suitable sandpaper 46 to treat the surface of a work piece. Since the gear reduction mechanism 38, the back plate 42, the resilient pad 44, and the manner in which they are operatively attached within the housing 16 form no part of the present invention, a further description thereof is deemed unnecessary herein.

Located generally medially of the housing 12, between the motor 28 and the gear reduction mechanism 38, is a centrifugal fan 48 mounted on and for rotation with the armature shaft 34. The fan 48 has two sets of blades or vanes, a lower set 50 and an upper set 52, separated by a circular flange 54. The housing 12, in radial alignment with the flange 54 is provided with an inwardly directed generally complementary flange portion 56 which defines in the housing 12 two fan housing chambers, a lower chamber 58 associated with the lower blades or vanes 50 and an upper chamber 60 associated with the set of blades or vanes 52. Accordingly, fan 48 serves to provide simultaneous air flow through two separate channels or flow paths in the housing 12 separated by the complementary flanges 54 and 56. In one channel or flow path, which may be referred to as the cooling air flow path, air is drawn by means of the upper set of fan vanes or blades 52 to be inducted through rectangular inlet openings 62 provided in the housing 12 generally above the motor 28 for flow past the motor 28 and exhaust flow outwardly of the housing 12 through generally rectangular cooling air exhaust openings 64 communicating with the upper fan chamber 60. An inwardly extending ridge 66 integrally formed with the housing 12 extends generally parallel and spaced apart above the flange 56 and the fan vanes 52 to further house the upper fan blades 52 and define an inlet opening 68 to aid in directing and controlling the cooling air flow.

Beneath the lower set of fan vanes or blades 50, there is provided another inwardly directed ridge generally parallel and spaced beneath the flange 56 and the lower fan vanes or blades 50 to provide a dust collecting inlet opening 72. The dust collection inlet openings 72 communicates or is directes, as shown, with the generally open bottom of the housing 12 and a housing shroud or skirt 74 may be provided generally encircling and enclosing the oscillatable platen 32. Hence, as indicated by the arrows 76, air flow is inducted by the lower fan vanes 50 substantially entirely around the periphery of the oscillatable platen 32 to entrain and draw dust created by the oscillatable platen 32 and the sandpaper 46, or the like, upwardly past the oscillatable platen 32, through the interior of the shroud 74 and the open bottom of the housing 12 into the lower, dust collecting fan chamber 58 and outwardly of the housing 12 through a rectangular opening 78 in an exhaust nozzle or outlet 80 formed integrally with the housing 12 in general alignment and communication with the dust collecting fan chamber 58. A dust collection bag, or the like, having a complementary collar mating with the exhaust nozzle or outlet 80 may be affixed thereto for collecting the created dust.

The skirt 74 positioned around the lower end of the housing 12 may be attached thereto in any suitable manner. In the embodiment shown, this skirt or shroud 74 is of relatively thin yieldable one-piece plastic material forming a loop, the upper end of which is slightly smaller than the outer periphery of the housing at the point of attachment. To attach the skirt or shroud 74 to the housing 12, the skirt or shroud 74 is stretched slightly so that its inwardly directed top flange 82 engages a shoulder 84 provided therefore on the housing 12. The skirt or shroud 74 is dimensioned such that its lower edge is slightly above the lower surface of the pad 44 and sandpaper 46, and there is therefore provided a free space 86 through which the dust collection air may flow.

As heretofore pointed out, the surface treating machine 10 of the present invention is particularly constructed and arranged to enable operation thereof in either a "dustless" configuration or mode of operation wherein dust created by the sandpaper 46 is inducted through the opening 86 and exhausted through the exhaust opening 78 into a dust collecting filter bag, or the like, or the machine 10 is constructed and arranged to also be selectively operated in a "normal" or "non-dustless" configuration or mode of operation wherein the dust created is merely left free to collect on the work surface being treated or to drift in the ambient air.

When being operated in a "normal" or "non-dustless" manner, in accordance with the present invention, the dust collecting air flow which would otherwise be produced by the lower set of vanes or blades 50 is obstructed between the oscillatable platen 32 and the fan inlet opening 72. To achieve this, a shutter arrangement designated by the reference character 88 is provided which comprises a movable shutter disc 90 and a fixed shutter disc 92 superposed one above the other beneath the inwardly extending ridge 70 and within a generally annular chamber 93 surrounding the armature shaft 34 of the motor 28 and being supported by an inwardly directed flange 94 formed integrally with the housing halves 14 and 16. The shutter discs 90 and 92 may be identical, of generally circular configuration and provided with a plurality of sector apertures 96 extending radially therearound having sector shaped radially extending ribs 98 therebetween of slightly greater angular extent than the apertures 96 so that, upon suitable angular rotational movement of one disc relative the other, the sector openings 96 may be selectively aligned by the operator to provide a through flow path for the dust collection air or misaligned with the ribs of each disc superposed and blocking the sector apertures 96 of the other of the discs 90 and 92. Each of the discs 90 and 92 may be further provided with a generally radially extending tang 102, the tang 102 of the fixed disc 92 being disposed in a mating slot 104 provided in the flange 94 of the housing 12 and the tang 102 of the movable disc 90 extending into a laterally elongated slot 106 in the housing 12 and movable therein for rotation of the disc 90. Further, enclosed within the slot 106, there may be positioned a handle 108 which includes a groove 110 which straddles an upraised rim 111 of the slot 106 so that the handle 108 is slidable within the slot 106 but restrained against outward movement by engagement of the upraised rim 111 in the groove 110. The handle 108 is further provided with a groove 112 for receiving the tang 102 of the movable shutter disc 90 in a mating complementary manner. Hence, sliding movement of the handle 108 will provide the requesite rotation of the movable shutter disc 90 to thereby effectuate selective obstruction or opening of the dirt collecting air flow from within the periphery of the skirt or shroud 74 to the dust collection fan vanes or blades 50 and outwardly through the exhaust outlet 78. When the shutter assembly 88 is closed, any flow of dust laden air from the region of the oscillatable platen 32 towards the motor compartment is effectively and positively precluded. If desired, a secondary exhaust outlet may be provided on the skirt or shroud 74 which may be selectively capped or equipped with a flexible hose, or the like, for collection of dust laden air by a canister or tank type vacuum cleaner.

Although the invention has been described in terms of a preferred embodiment or modification, such technical equivalence to the means described as well as their combination, and such other embodiments or modifications as may be suggested to those having the benefit of the teachings herein are intended to be reserved should they be carried out according to the spirit of the invention.

I claim:

1. In an electrically driven portable surface treating machine such as a sander, polisher, buffer, and the like, having an oscillatable platen driven from a motor shaft and which creates dust during use, a dust collection fan on the motor shaft in a fan housing portion of the tool housing, and an exhaust outlet or port which can selectively be fitted with dust collection means, such as a filter bag the improvement comprising a selective shutter arrangement between said platen and said fan which may be selectively opened and closed by the machine operator to enable the machine to be selectively operated in either a "dustless" or a "non-dustless" mode of operation.

2. Surface treating machine defined in claim 1 wherein said shutter arrangement comprises a pair of generally circular superposed plates each of which are provided with a plurality of alternating radial sector openings and ribs, one of said plates being non-rotatable relative to the housing, and the other of said plates being rotatable by the operator to selectively align the sector oepnings thereof selectively with the sector openings of the non-rotatable plate to enable air flow therethrough for dust collection and "dustless" operation or with said ribs of the non-rotatable plate covering the sector openings of said rotatable plate and the ribs of said rotatable plate covering the sector openings of said non-rotatable plate, blocking air flow therethrough and enabling "normal" or "non-dustless" operation of the machine.

3. Surface treating machine defined in claim 2 wherein the oscillatable platen is enclosed within a shroud or skirt and the interior of the shroud or skirt is ducted to the inlet of the dust collection fan housing portion.

4. Surface treating machine defined in claim 2 wherein said non-rotatable plate comprises a radial tang which extends into a mating complementary slot in the tool housing.

5. Surface treating machine defined in claim 4 wherein said rotatable plate comprises a radial tang extending through a slot in the tool housing for operator rotation.

* * * * *